US009425020B2

(12) United States Patent
Duan et al.

(10) Patent No.: US 9,425,020 B2
(45) Date of Patent: Aug. 23, 2016

(54) MINIATURIZED ALL-METAL SLOW-WAVE STRUCTURE

(71) Applicant: University of Electronic Science and Technology of China, Chengdu, Sichuan (CN)

(72) Inventors: Zhaoyun Duan, Sichuan (CN); Yanshuai Wang, Sichuan (CN); Xiang Huang, Sichuan (CN); Xinwu Ma, Sichuan (CN); Tao Tang, Sichuan (CN); Minzhi Huang, Sichuan (CN); Zhanliang Wang, Sichuan (CN); Yubin Gong, Sichuan (CN)

(73) Assignee: niversity of Electronic Science and Technology of China, Chengdu, Sichuan (CN)

( * ) Notice: Subject to any disclaimer, the term of this patent is extended or adjusted under 35 U.S.C. 154(b) by 14 days.

(21) Appl. No.: 14/572,035

(22) Filed: Dec. 16, 2014

(65) Prior Publication Data

US 2015/0155128 A1 Jun. 4, 2015

(30) Foreign Application Priority Data

Jun. 21, 2014 (CN) ..... 2014 1 0280414

(51) Int. Cl.
*H01J 23/24* (2006.01)

(52) U.S. Cl.
CPC ..... *H01J 23/24* (2013.01)

(58) Field of Classification Search
None
See application file for complete search history.

(56) References Cited

U.S. PATENT DOCUMENTS 2,985,792 A * 5/1961 Bates ..... H01J 23/0873 315/3.5
3,028,597 A * 4/1962 Kliger ..... H01J 25/38 315/3.5
3,471,738 A * 10/1969 Bert ..... H01J 23/24 315/3.5
3,475,642 A * 10/1969 Karp ..... H01J 23/24 315/3.5
4,742,271 A * 5/1988 MacMaster ..... H01J 25/42 315/39.3

(Continued)

OTHER PUBLICATIONS

W.Wang et al "Review of the Novel Slow-Wave Structures for High-Power Travelling—Wave Tube" International Journal of Infrared and Millimeter Waves vol. 24 No. 9 Sep. 2003 p. 1469-1484.*

*Primary Examiner* — Douglas W Owens
*Assistant Examiner* — Srinivas Sathiraju

(57) ABSTRACT

A miniaturized all-metal slow-wave structure includes: a circular metal waveguide; and metal electric resonance units provided in the circular metal waveguide; wherein the metal electric resonance unit provided in the circular metal waveguide includes a ring-shaped electric resonance metal plate with an electron beam tunnel provided on a center thereof, and a ring plate body of the ring-shaped electric resonance metal plate has two auricle-shaped through-holes symmetrically aside an axial-section; a main body of the auricle-shaped through-hole is a ring-shaped hole, two column holes extending towards a center of a circle are provided at two ends of the ring-shaped hole; the ring-shaped electric resonance metal plates are perpendicular to an axis and are provided inside the circular metal waveguide with equal intervals therebetween, external surfaces of the ring-shaped electric resonance metal plates are mounted on an internal surface of the circular metal waveguide.

5 Claims, 11 Drawing Sheets

(56) References Cited

U.S. PATENT DOCUMENTS 4,866,343 A * 9/1989 James ..... H01J 23/24 315/3.5
5,227,701 A * 7/1993 McIntyre ..... H01J 25/36 315/39.3
5,412,684 A * 5/1995 Schlie ..... H01S 3/0975 372/56
5,477,107 A * 12/1995 Tammaru ..... H01J 23/30 315/3.5
5,510,151 A * 4/1996 Matsuyama ..... C23C 16/511 118/718
5,976,257 A * 11/1999 Kanai ..... C23C 16/46 118/718
6,417,622 B2 * 7/2002 Theiss ..... H01J 23/22 315/3.5
6,476,771 B1 * 11/2002 McKinzie, III ..... H01Q 1/425 333/134
6,593,695 B2 * 7/2003 Theiss ..... H01J 23/22 315/3.5
7,521,890 B2 * 4/2009 Lee ..... H02J 5/005 320/108
8,837,551 B2 * 9/2014 Duan ..... H01J 25/00 372/20
2001/0013757 A1 * 8/2001 Theiss ..... H01J 23/22 315/3.5
2003/0030390 A1 * 2/2003 Theiss ..... H01J 23/22 315/500
2007/0145830 A1 * 6/2007 Lee ..... H02J 5/005 307/135
2007/0292073 A1 * 12/2007 Li ..... G02F 1/0121 385/14
2008/0272698 A1 * 11/2008 Dayton ..... H01J 25/34 315/3.5
2012/0062346 A1 * 3/2012 McKinzie, III ..... H01P 1/16 333/251
2012/0119646 A1 * 5/2012 Wei ..... H01J 25/34 315/3.5
2012/0146881 A1 * 6/2012 McKinzie, III ..... H01P 1/2005 343/909
2015/0155128 A1 * 6/2015 Duan ..... H01J 23/24 315/3.6

* cited by examiner

MINIATURIZED ALL-METAL SLOW-WAVE STRUCTURE

CROSS REFERENCE OF RELATED APPLICATION

The present invention claims priority under 35 U.S.C. 119 (a-d) to CN 201410280414.4, filed Jun. 21, 2014.

BACKGROUND OF THE PRESENT INVENTION

1. Field of Invention

The present invention relates to a field of vacuum electronic technology, and more particularly to a sub-wavelength miniaturized all-metal slow-wave structure based on electric resonance, which is a high frequency part of a traveling-wave tube or a backward wave tube operating in the centimeter wave and millimeter wave bands, and has a high power capacity. Under a same operating condition, a sectional area of the slow-wave structure is only 35-50% of a conventional slow-wave structure.

2. Description of Related Arts

There are some advantages such as high power and high efficiency for vacuum electron devices, which play an important role on large scientific devices of electronic science and technology fields such as communication, radar, guidance, electronic countermeasure, microwave heating, accelerator and controlled thermonuclear fusion. With the rapid development of semiconductor power devices, vacuum electron devices such as traveling-wave tube face enormous challenges in communication, radar, etc. Because of high efficiency, large power and strong resistance to various radiations from outer space, space traveling-wave tube is one of the heart devices of satellite communication. However, how to reduce volume and weight thereof and how to further improve electron efficiency are the major problems. In addition, vacuum electron devices with small volume and high power are badly needed as a radiation source for electronic interference; and power source with continuous wave, high power and small volume is needed for microwave heating. Slow-wave structure is one of the core components of traveling-wave tube and backward wave tube. Due to the interaction of electron beam and electromagnetic wave in the slow-wave structure, the kinetic energy of the electron beam is transformed into high power microwave or millimeter wave for being outputted. Conventionally, the slow-wave structures commonly used comprises helix, coupled-cavity, meandering waveguide and rectangular grid slow-wave structure, and the most widely used slow-wave structures are helix and the coupled-cavity slow-wave structures.

Conventionally, because of a wide band, the helix traveling-wave tube is the most widely used one. However, because the coupling impedance thereof is relatively low, the output power is limited, which means the conventional helix traveling wave tube belongs to a medium or small power amplifier. For example, coupling impedance of the helix traveling-wave tube operating at S band is 100-200 ohms. Because dielectric material is loaded, inner heat is difficult to be transferred outside, and the helix traveling-wave tube is easy to be broken by high heat. Therefore the power capacity is small. The coupled-cavity traveling-wave tube is an all-metal slow-wave device with high power capacity, which is an amplifier with the highest power output compared with other traveling-wave tubes at present. Coupling impedance thereof at S band is 300-400 ohms. However, because of a complex structure, the coupled-cavity traveling-wave tube is difficult to be assembled and is not conducive to mass production. According to working principles of the traveling-wave tubes, the maximum output power is in proportion to ⅓-power of the coupling impedance. Therefore, improving the coupling impedance is one of the effective methods for improving output power and efficiency of the traveling-wave tube, and improving the coupling impedance is actually enhancing longitudinal electric field intensity in the slow-wave structure.

In 1996, Pendry et al. from Imperial College London utilized a metal rod array with certain periodic for forming an effective medium whose effective permittivity has a negative real part (J. B. Pendry, A. J. Holden, W. J. Stewart, and I. Youngs. *Extremely low frequency plasmons in metallic mesostructures. Phys. Rev. Lett., Vol.* 76, 4773-4776, 1996). In 2005, based on the theory of Pendry et al., Spanish scholars Esteban et al. loaded two-dimensional metal rods (generally formed by copper) into a rectangular waveguide operating at a cutoff frequency, which illustrates by principle that the waveguide is also able to spread quasi-TM waves (J. Esteban, C. Camacho-Penalosa, J. E. Page, T. M. Martin-Guerrero, and E. Marquez-Segura. *Simulation of negative permittivity and negative permeability by means of evanescent waveguide modes-theory and experiment. IEEE Trans. Microwave Theory Tech., Vol.* 53, No. 4, 1506-1514, 2005). However, electron beam channel is not able to be well formed in the rectangular waveguide loaded with the artificial electromagnetic medium, and electron efficiency thereof is low. As a result, the structure is not applicable in vacuum electronic devices.

SUMMARY OF THE PRESENT INVENTION

An object of the present invention is to provide a miniaturized all-metal slow-wave structure for solving the above technical problems, wherein the miniaturized all-metal slow-wave structure has a high power capacity and is based on electric resonance, for achieving a simple structure and convenient processing, effectively increasing output power and electron efficiency by increasing a coupling impedance, achieving a small volume, etc.

Accordingly, in order to accomplish the above object, the present invention is based on the reversed Cherenkov coherent electromagnetic radiation. A cylinder metal shell is utilized as a circular metal waveguide for replacing a conventional rectangular waveguide. At the same time, a set of electric resonance metal plates (units) parallel to each other is provided in the circular metal waveguide and is perpendicular to an axis of the circular metal waveguide. Each of the electric resonance metal plates has an electron beam tunnel provided at a center thereof, and a ring plate body of the electric resonance metal plate has two auricle-shaped through-holes symmetrically aside a diameter, in such a manner that electric resonance generated localizes electromagnetic energy for greatly enhancing longitudinal electric field intensity, so as to enhance interaction of the slow-wave structure and electron beams. According to the present invention, an inner diameter of the circular metal waveguide is a sub-wavelength of a free space wavelength of an electromagnetic wave operating at a center frequency, and an interval between the adjacent electric resonance metal plates provided in the circular metal waveguide in parallel are also decided by a guide wavelength of the electromagnetic wave operating at the center frequency. The whole structure is made of oxygen-free copper and comprises no insulating medium. With the foregoing structure, the objects of the present invention are achieved. Therefore, the miniaturized all-metal slow-wave structure comprises: the circular metal waveguide; and a plurality of the metal electric resonance units provided in the circular metal waveguide; wherein the circular metal waveguide has an inner diameter of no longer than ⅓ free space wavelength of an electromagnetic wave operating at a center frequency; each of the metal electric resonance units provided in the circular metal waveguide comprises a ring-shaped electric resonance metal plate with an electron beam tunnel provided on a center thereof, and a ring plate body of the ring-shaped electric resonance metal plate has two auricle-shaped through-holes symmetrically aside an axial-section; a main body of every auricle-shaped through-hole is a ring-shaped hole, two column holes extending towards a center of a circle of the ring-shaped hole are respectively provided at two ends of the ring-shaped hole; the ring-shaped electric resonance metal plates are perpendicular to an axis of said circular metal waveguide and are provided inside the circular metal waveguide with equal intervals therebetween, the ring-shaped electric resonance metal plates are mounted on an internal surface of the circular metal waveguide.

The diameters of the electron beam tunnels equal to each other and are 0.25-0.35 the inner diameter of the circular metal waveguide. The ring plate body of the ring-shaped electric resonance metal plate has the two auricle-shaped through-holes symmetrically aside the axial-section; an interval between end faces facing each other of the auricle-shaped through-holes symmetrical to each other on the ring-shaped electric resonance metal plate is 0.05-0.075 the inner diameter of the circular metal waveguide. The main body of the auricle-shaped through-hole is the ring-shaped hole, the two column holes extending towards the center of the circle of the ring-shaped hole are respectively provided at the two ends of the ring-shaped hole; an external diameter of the ring-shaped hole is 0.85-0.95 the inner diameter of the circular metal waveguide, a distance between an inner hole surface and an outer hole surface of the ring-shaped hole (i.e. a radial width of the ring-shaped hole) is 0.125-0.175 the inner diameter of the circular metal waveguide, a bottom width of the column hole is 0.05-0.175 the inner diameter of the circular metal waveguide, and a perpendicular distance between a bottom of the column hole and a center line of the circular metal waveguide (i.e. a vertical line length between the center line and an expending surface of the bottom of the column hole) is 0.55-0.65 the inner diameter of the circular metal waveguide. The ring-shaped electric resonance metal plates are perpendicular to the axis and are provided inside the circular metal waveguide with the intervals therebetween; a quantity of the ring-shaped electric resonance metal plates is 15-30, the interval between two adjacent ring-shaped electric resonance metal plates is no longer than ⅗ guide wavelength of an electromagnetic wave operating at a center frequency, a thickness of the ring-shaped electric resonance metal plate is 1-2 mm. The inner diameter of the circular metal waveguide is no longer than ⅓ the free space wavelength of the electromagnetic wave operating at the center frequency, and the inner diameter of the circular metal waveguide is 0.15-0.25 the free space wavelength of the electromagnetic wave operating at the center frequency.

According to the present invention, the cylinder metal shell is utilized as the circular metal waveguide for replacing a conventional rectangular waveguide. At the same time, a set of the electric resonance metal plates parallel to each other is provided in the circular metal waveguide and is perpendicular to the axis of the circular metal waveguide. Each of the electric resonance metal plates has the electron beam tunnel provided at the center thereof, and the ring plate body of the electric resonance metal plate has the two auricle-shaped through-holes symmetrically aside the diameter. Because of the auricle-shaped through-holes symmetrically provided on each ring plate body of the electric resonance metal plate, the magnetoelectric response is eliminated and only electric resonance generated by electric dipoles exists. Due to the electric resonance, the electromagnetic energy is localized, which greatly enhances the longitudinal electric field intensity and greatly increases the coupling impedance, in such a manner that the output power and the electron efficiency of the slow-wave structure. Furthermore, the inner diameter of the circular metal waveguide is the sub-wavelength of the electromagnetic wave operating at the center frequency and is made of metal (oxygen-free copper) which has a high breakdown voltage and is conducive to heat radiation and increasing the power capacity, which enable the slow-wave structure to be small. According to the present invention, a diameter of an S-band all-metal slow-wave structure is 40 mm, while a diameter of a conventional S-band circular waveguide is 114 mm (according to a $TM_{01}$ mode). A cross-section of the present invention is only about 12.5% that of the conventional structure. For example, a conventional S-band coupled-cavity traveling-wave tube has a cross-section of generally 50×50 mm to 60×60 mm, and the cross-section of the present invention is only 35-50% of the cross-section of the conventional S-band coupled-cavity traveling-wave tube. Therefore, the present invention has advantages such as a small volume, a simple structure, high power capacity, high output power as well as electron efficiency, easy industrialization production.

These and other objects, features, and advantages of the present invention will become more apparent from the following detailed description, the appended claims and the drawings.

Figure 1:
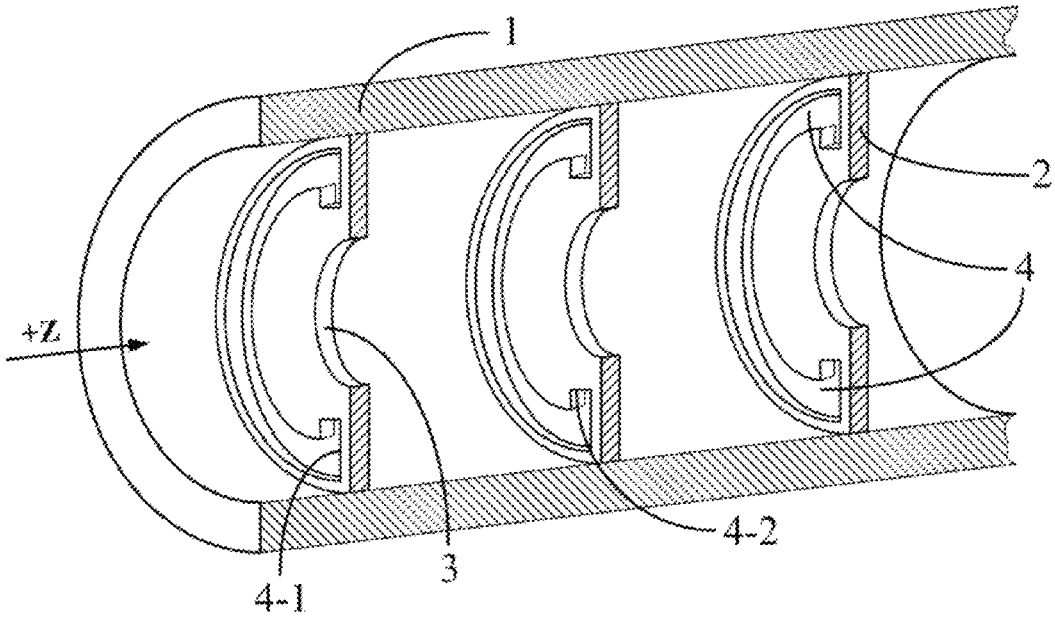
FIG. 1 is a sectional view of the present invention.
Figure 2:
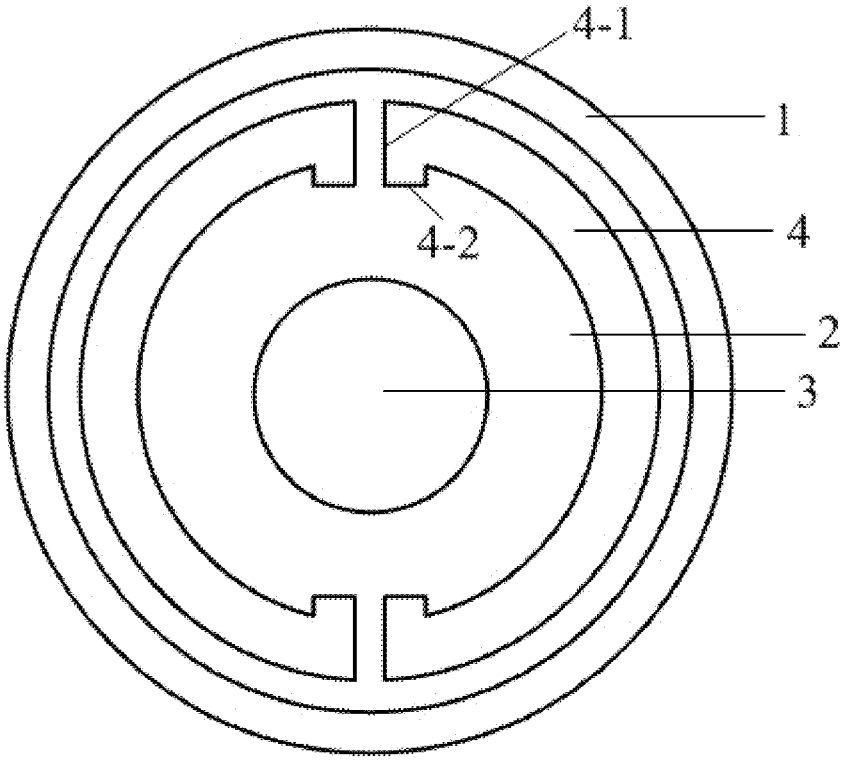
FIG. 2 is a Z-direction view of FIG. 1.

Element reference: 1: circular metal waveguide, 2: ring-shaped electric resonance metal plate, 3: electron beam tunnel, 4: auricle-shaped through-hole, 4-1: end face, 4-2: bottom.

DETAILED DESCRIPTION OF THE PREFERRED EMBODIMENT

A miniaturized all-metal slow-wave structure as illustrated in a preferred embodiment works within a frequency range of 2.45-2.50 GHz.

A guide wavelength of a guided electromagnetic wave operating at a center frequency of 2.475 GHz is 85 mm, and a free space wavelength thereof is 110 mm. According to the preferred embodiment, an inner diameter of a circular metal waveguide 1 is 40 mm, and a wall thickness thereof is 5 mm. 24 ring-shaped electric resonance metal plates 2 are provided in the circular metal waveguide, and a center-to-center distance between adjacent ring-shaped electric resonance metal plates 2 is 30 mm. An outer diameter of the ring-shaped electric resonance metal plate 2 is 40 mm, and a thickness thereof is 1.2 mm. A diameter of an electron beam tunnel 3 is 12 mm. An outer radius of ring-shaped holes of two auricle-shaped through-holes 4 symmetrically provided aside an axial-section is 18 mm, and an inner radius thereof is 15 mm (which illustrates that a distance between an inner hole surface and an outer hole surface of the ring-shaped hole is 3 mm) Widths of bottoms 4-2 of column holes at two ends of the ring-shaped hole is 3 mm. A perpendicular distance between the bottom 4-2 of the column hole and a center line of the circular metal waveguide 1 is 13 mm (which illustrated that a radial width of the end face 4-1 of the auricle-shaped through-hole is 5 mm). A distance between the end faces 4-1 of the auricle-shaped through-holes on the same ring-shaped electric resonance metal plate 2 is 2 mm. The circular metal waveguide 1 and the ring-shaped electric resonance metal plate 2 are made of oxygen-free copper. An external surface of the ring-shaped electric resonance metal plate 2 is mounted on an internal surface of the circular metal waveguide 1.

Figure 3A:
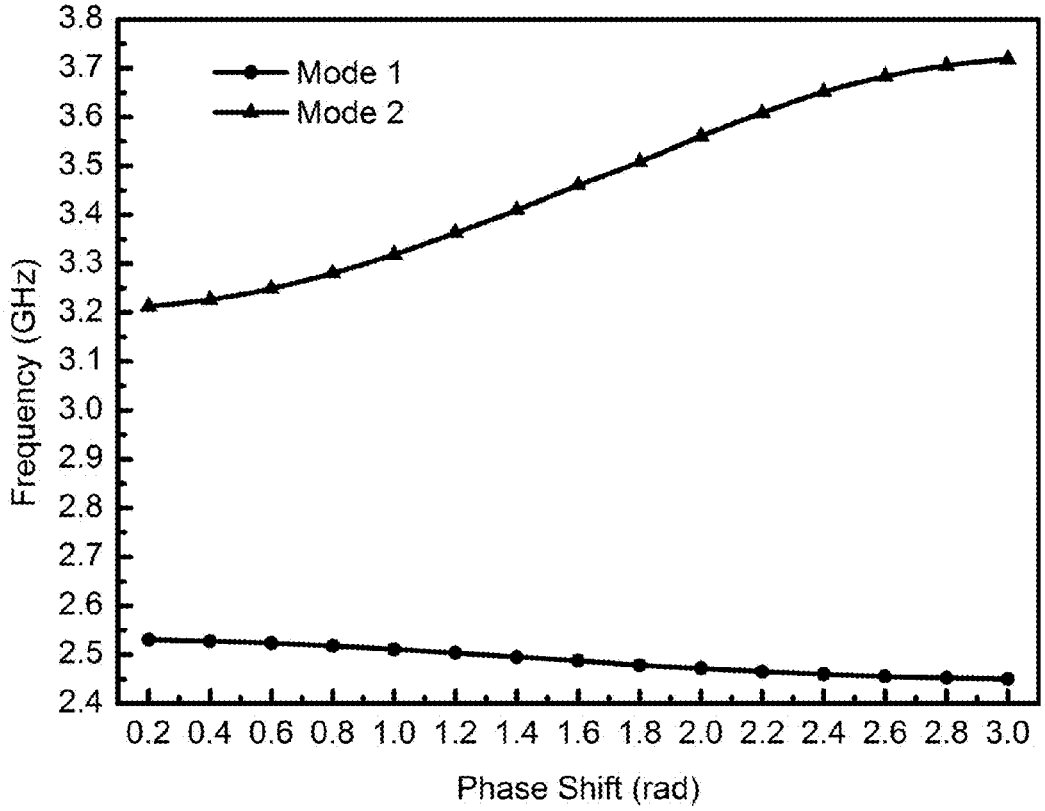
FIG. 3*a* is a dispersion curve comparison chart of a mode 1 and a mode 2 according to a preferred embodiment of the present invention.
Figure 3B:
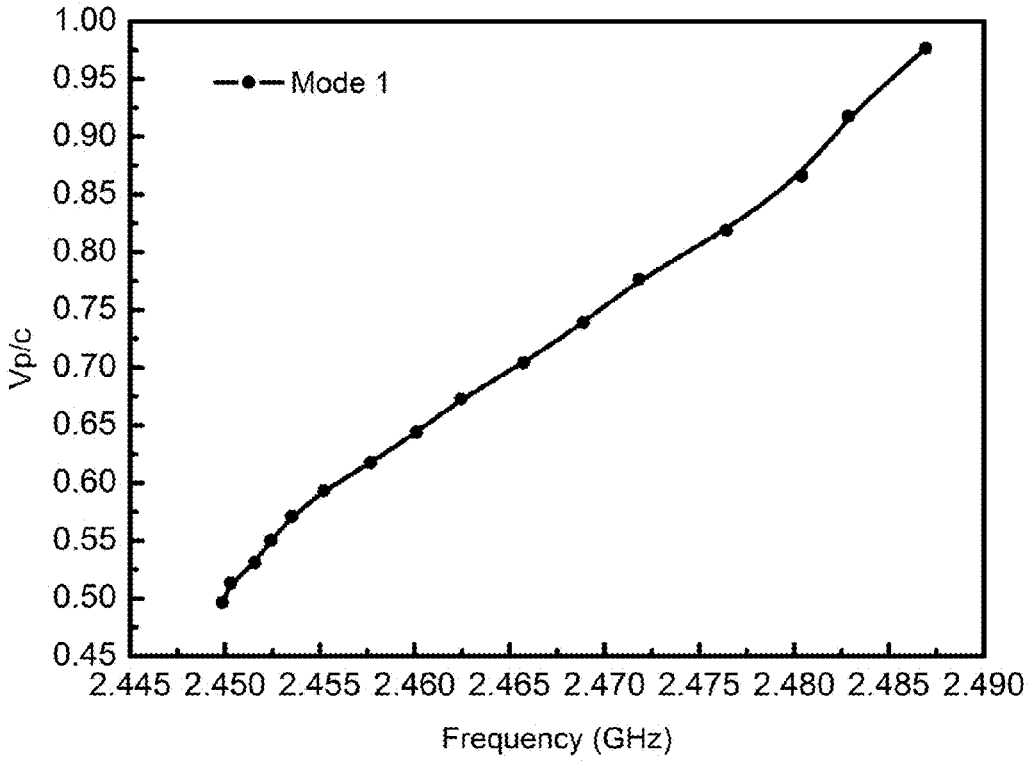
FIG. 3*b* is a normalized phase velocity chart of the mode 1 according to the preferred embodiment of the present invention.
Figure 4A:
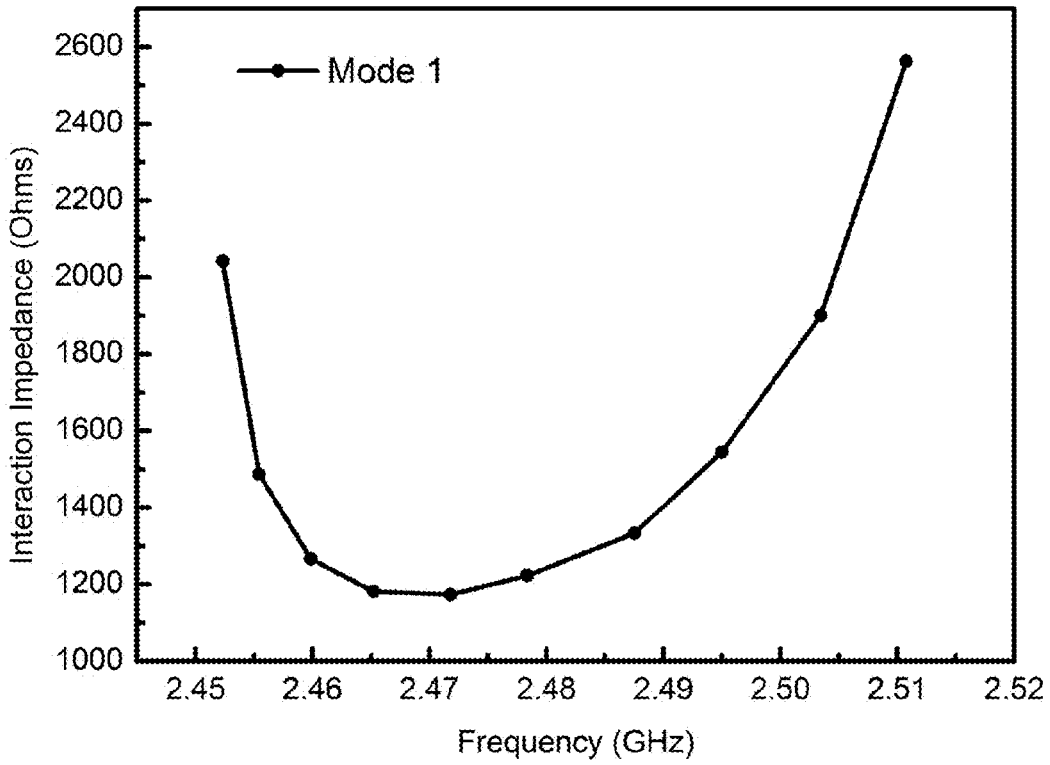
FIG. 4*a* is a coupling impedance contrast diagram of the mode 1 according to the preferred embodiment of the present invention.
Figure 4B:
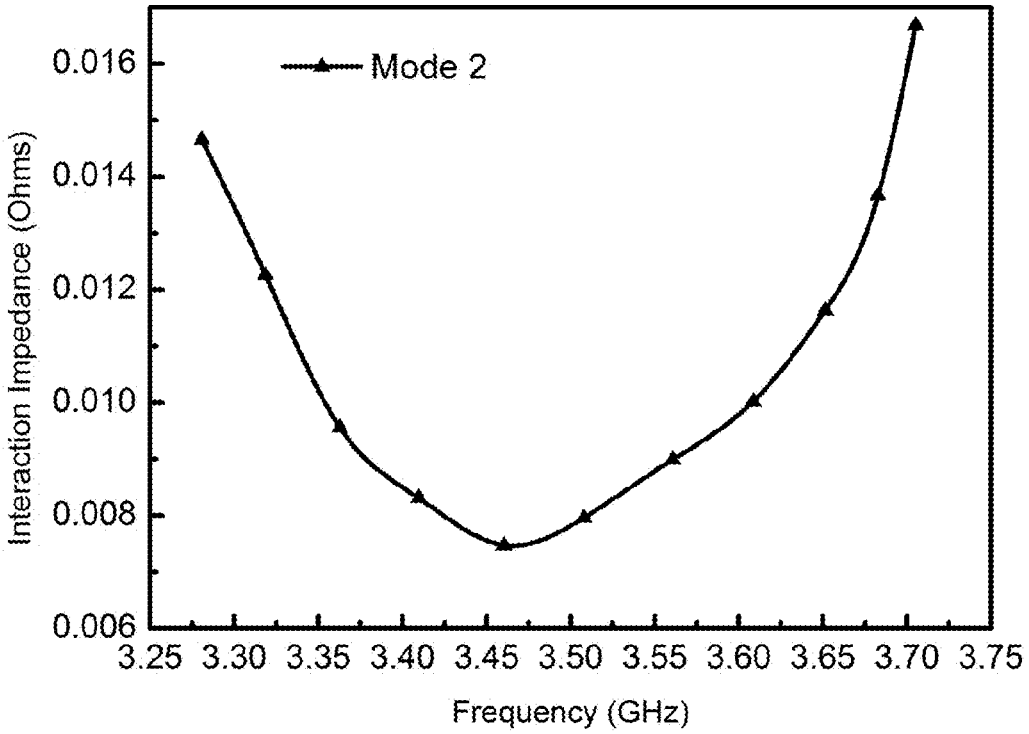
FIG. 4*b* is a coupling impedance contrast diagram of the mode 2 according to the preferred embodiment of the present invention.
Figure 5:
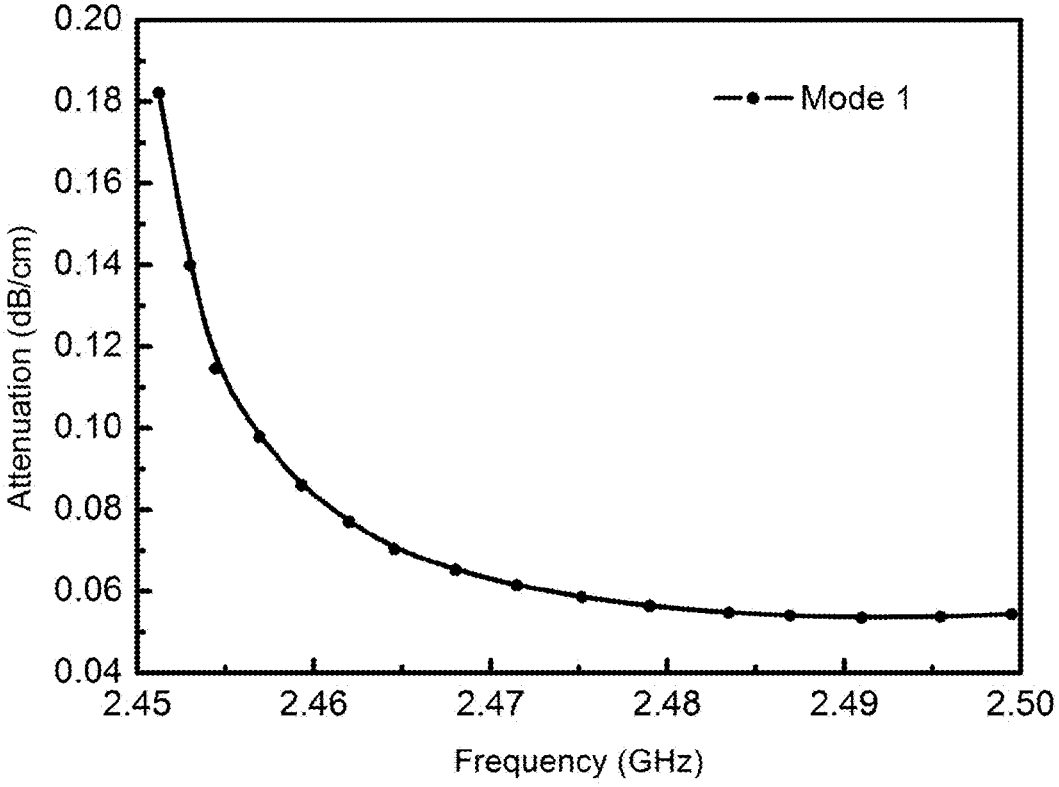
FIG. 5 is an attenuation-frequency diagram of the mode 1 according to the preferred embodiment of the present invention.
Figure 6A:
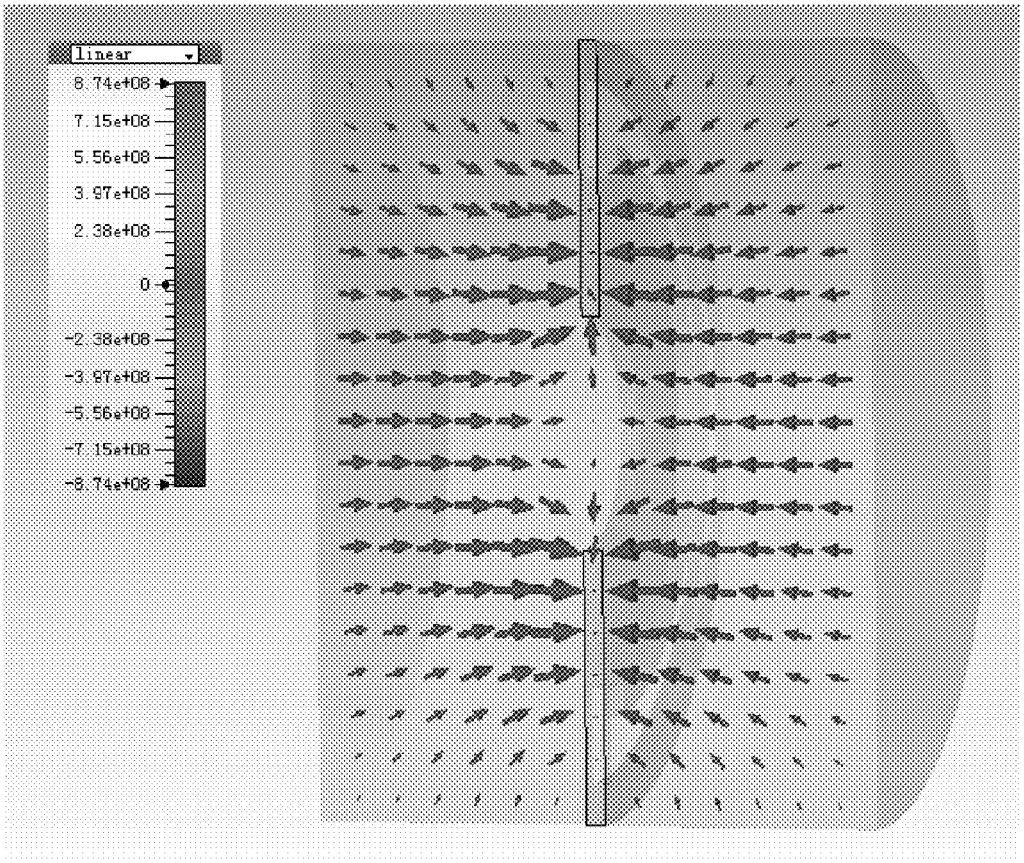
FIG. 6*a* is a distribution view of a vertical axial-section electric field of the mode 1 according to the preferred embodiment of the present invention.
Figure 6B:
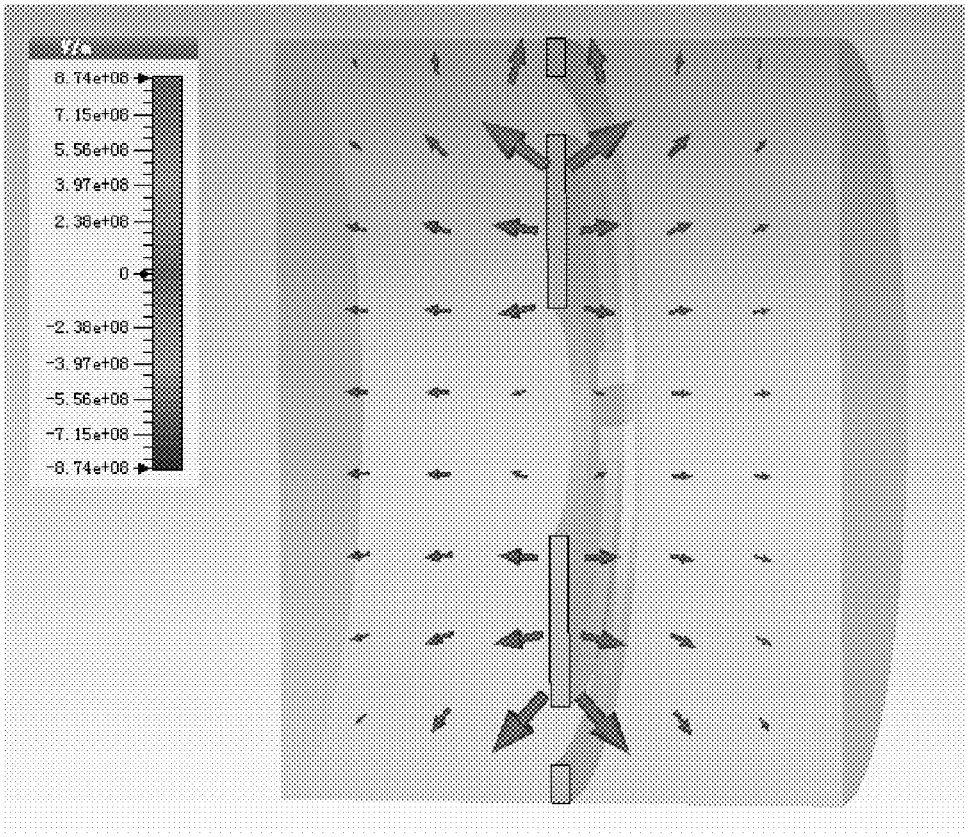
FIG. 6*b* is a distribution view of a horizontal axial-section electric field of the mode 1 according to the preferred embodiment of the present invention.
Figure 7:
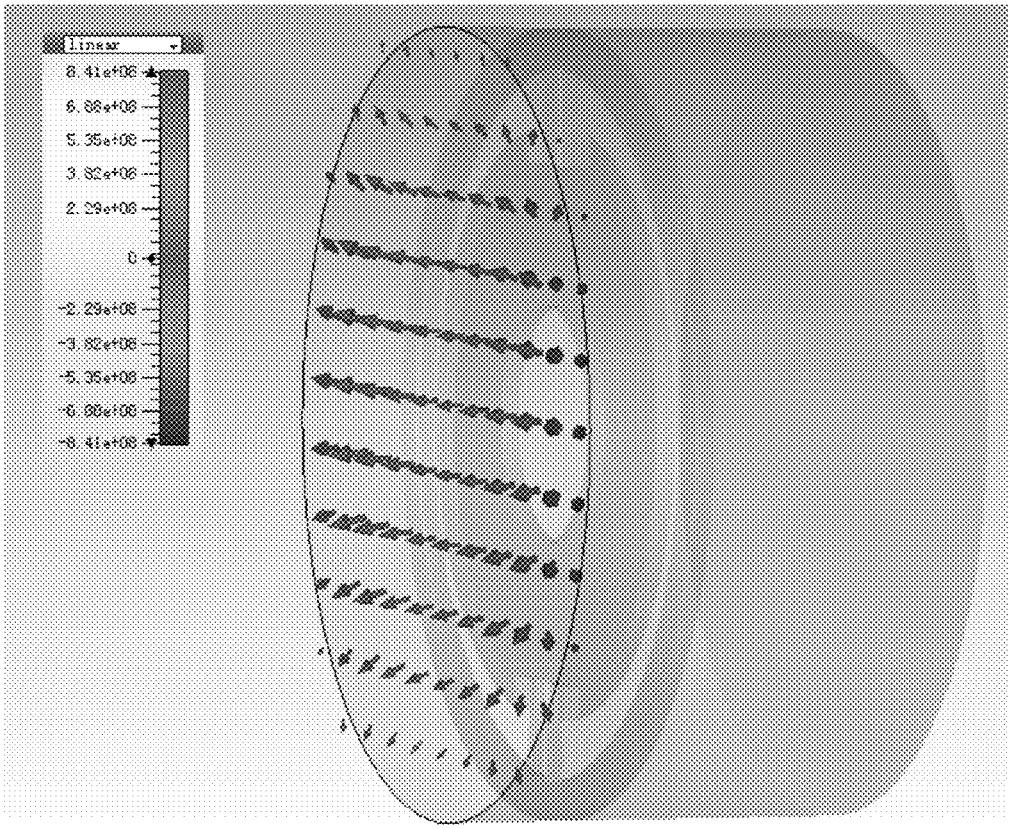
FIG. 7 is a distribution view of a cross-section electric field of the mode 1 according to the preferred embodiment of the present invention.
Figure 8:
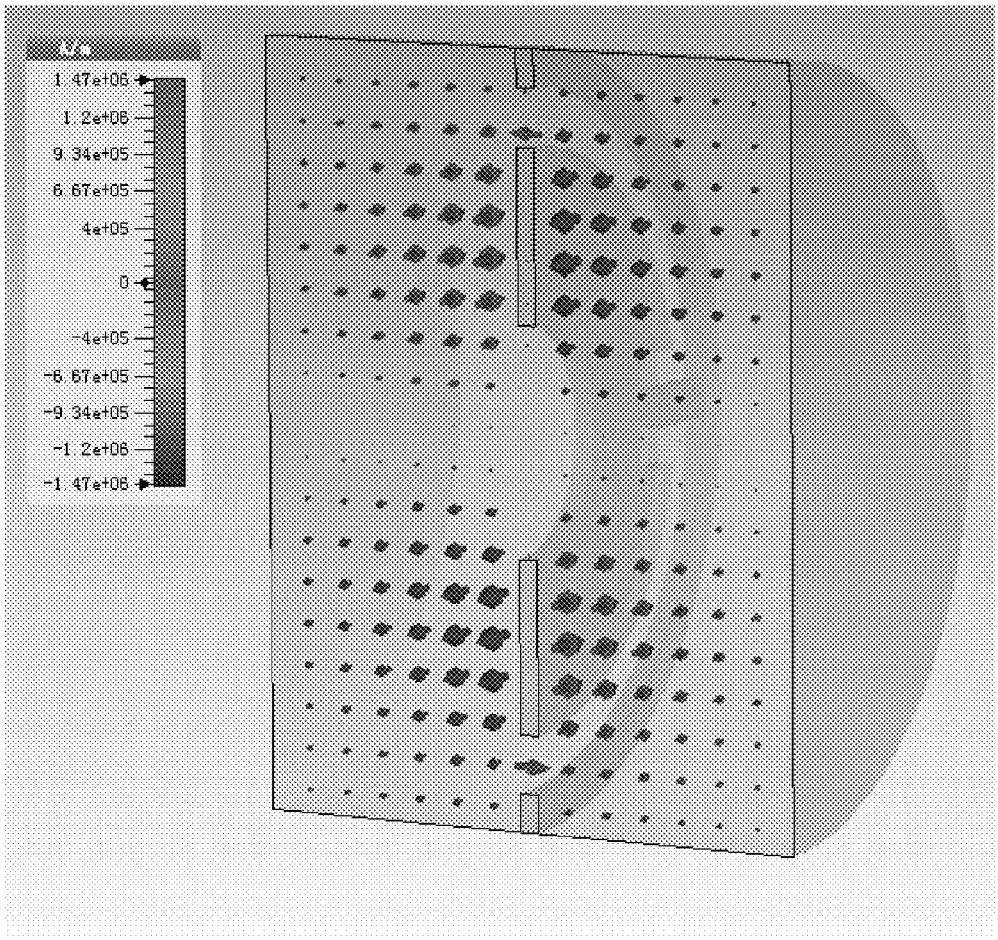
FIG. 8 is a distribution view of a horizontal axial-section magnetic field of the mode 1 according to the preferred embodiment of the present invention.

The preferred embodiment is simulated with a three-dimensional electromagnetic simulation software, wherein FIG. 3*a* is a dispersion curve comparison chart of a mode 1 and a mode 2, and FIG. 3*b* is a normalized phase velocity map of the mode 1. Referring to FIG. 3*a*, the mode 1 is a backward wave, wherein a phase velocity direction thereof is opposite to a group velocity direction thereof. Mode 2 is a forward wave, wherein a phase velocity direction thereof equals to a group velocity direction thereof. According to the preferred embodiment, the mode 1 is an operating mode. Referring to FIG. 3*b*, a normalized phase velocity (represented by a ratio of phase velocity and light speed) of the mode 1 is 0.56-0.86. FIG. 4*a* is a coupling impedance contrast diagram of the mode 1 according to the preferred embodiment. FIG. 4*b* is a coupling impedance contrast diagram of the mode 2 according to the preferred embodiment. Referring to FIG. 4*a* and FIG. 4*b*, compared with slow-wave structures such as a helix slow-wave structure and a coupled-cavity slow-wave structure (coupling impedances thereof are illustrated in the Description of Related Arts), a coupling impedance according to the present invention is increased by 2-3 times. With the higher coupling impedance, output power and electron efficiency of the device are greatly increased. According to the mode 1 (the operating mode), the coupling impedance of the mode 2 (a high order mode) is extremely low (about 5 orders of magnitude), which is conducive to greatly resists interference of the high order mode and purifying an operating spectrum of a signal. FIG. 5 is an attenuation-frequency diagram of the mode 1 according to the preferred embodiment of the present invention. Referring to FIG. 5, an attenuation constant of the mode 1 is 0.053-0.14 dB/cm within an operating frequency range of 2.45-2.50 GHz, which fully illustrates that the slow-wave structure according to the preferred embodiment is more conducive to increasing electron efficiency and output power of a traveling-wave tube or a backward wave tube. FIG. 6*a*, FIG. 6*b* and FIG. 7 are distribution views of electric fields. FIG. 8 is a distribution view of a magnetic field. Accordingly, an operating mode is a quasi-TM mode, which is the operating mode for the traveling-wave tube or the backward wave tube, and is able to work in the millimeter wave and terahertz wave bands according to a scaling principle in an electromagnetic theory.

According to the preferred embodiment, a diameter of the cylinder miniaturized all-metal structure operating at the S-band is 40 mm, while a diameter of a conventional S-band circular waveguide is 114 mm (according to a $TM_{01}$ mode). A cross-section of the present invention is only about 12.5% that of the conventional structure. For example, a conventional S-band coupled-cavity traveling-wave tube has a cross-section of generally 50×50 mm to 60×60 mm, and a cross-section according to the preferred embodiment is only 35-50% of the cross-section of the conventional S-band coupled-cavity traveling-wave tube.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A miniaturized all-metal slow-wave structure, comprising: a circular metal waveguide; and a plurality of metal electric resonance units provided in said circular metal waveguide; wherein said circular metal waveguide has an inner diameter of no longer than ⅓ free space wavelength of an electromagnetic wave operating at a center frequency; wherein said inner diameter of said circular metal waveguide is 0.15-0.25 said free space wavelength of said electromagnetic wave operating at said center frequency; each of said metal electric resonance units provided in said circular metal waveguide comprises a ring-shaped electric resonance metal plate with an electron beam tunnel provided on a center thereof, and a ring plate body of said ring-shaped electric resonance metal plate has two auricle-shaped through-holes symmetrically aside an axial-section; a main body of every auricle-shaped through-hole is a ring-shaped hole, two column holes extending towards a center of a circle of said ring-shaped hole are respectively provided at two ends of said ring-shaped hole; ring-shaped electric resonance metal plates are perpendicular to an axis of said circular metal waveguide and are provided inside said circular metal waveguide with equal intervals there between, external surfaces of said ring-shaped electric resonance metal plates are mounted on an internal surface of said circular metal waveguide.

2. The miniaturized all-metal slow-wave structure, as recited in claim 1, wherein diameters of said electron beam tunnels equal to each other and are 0.25-0.35 said inner diameter of said circular metal waveguide.

3. The miniaturized all-metal slow-wave structure, as recited in claim 1, wherein said ring plate body of said ring-shaped electric resonance metal plate has said two auricle-shaped through-holes symmetrically aside said axial-section; an interval between end faces facing each other of said auricle-shaped through-holes symmetrical to each other on said ring-shaped electric resonance metal plate is 0.05-0.075 said inner diameter of said circular metal waveguide.

4. The miniaturized all-metal slow-wave structure, as recited in claim 1, wherein said main body of said auricle-shaped through-hole is said ring-shaped hole, said two column holes extending towards said center of said circle are respectively provided at said two ends of said ring-shaped hole; an external diameter of said ring-shaped hole is 0.85-0.95 said inner diameter of said circular metal waveguide, a distance between an inner hole surface and an outer hole surface of said ring-shaped hole is 0.125-0.175 said inner diameter of said circular metal waveguide, a bottom width of said column hole is 0.05-0.175 said inner diameter of said circular metal waveguide, and a perpendicular distance between a bottom of said column hole and a center line of said circular metal waveguide is 0.55-0.65 said inner diameter of said circular metal waveguide.

5. The miniaturized all-metal slow-wave structure, as recited in claim 1, wherein said ring-shaped electric resonance metal plates are perpendicular to said axis and are provided inside said circular metal waveguide with said intervals therebetween; a quantity of said ring-shaped electric resonance metal plates is 15-30, said interval between two adjacent ring-shaped electric resonance metal plates is no longer than ⅗ a guide wavelength of an electromagnetic wave operating at a center frequency, a thickness of said ring-shaped electric resonance metal plate is 1-2 mm.

* * * * *